US008461771B2

(12) United States Patent
Pollischansky

(10) Patent No.: US 8,461,771 B2
(45) Date of Patent: Jun. 11, 2013

(54) ELECTRONIC BALLAST FOR A DISCHARGE LAMP

(75) Inventor: Thomas Pollischansky, Munich (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 199 days.

(21) Appl. No.: 12/739,411

(22) PCT Filed: Oct. 26, 2007

(86) PCT No.: PCT/EP2007/061555

§ 371 (c)(1),
(2), (4) Date: Apr. 23, 2010

(87) PCT Pub. No.: WO2009/052868

PCT Pub. Date: Apr. 30, 2009

(65) Prior Publication Data

US 2010/0308741 A1 Dec. 9, 2010

(51) Int. Cl.
*H05B 37/02* (2006.01)

(52) U.S. Cl.
USPC ..... 315/291; 315/362

(58) Field of Classification Search
USPC ..... 315/209 R, 291, 362
See application file for complete search history.

(56) References Cited

U.S. PATENT DOCUMENTS

| | | | | |
|---|---|---|---|---|
| 5,138,137 | A | 8/1992 | Holling et al. | |
| 5,615,093 | A | 3/1997 | Nalbant | |
| 5,703,439 | A | 12/1997 | Nerone | |
| 5,798,620 | A * | 8/1998 | Wacyk et al. | 315/307 |
| 6,211,624 | B1 | 4/2001 | Holzer | |
| 7,235,958 | B2 * | 6/2007 | Brassfield et al. | 323/282 |
| 2005/0018682 | A1 | 1/2005 | Ferguson et al. | |
| 2005/0184682 | A1 | 8/2005 | Ribarich | |
| 2007/0085488 | A1 | 4/2007 | Ribarich et al. | |

FOREIGN PATENT DOCUMENTS

| | | | |
|---|---|---|---|
| DE | 19719064 | A1 | 11/1997 |
| DE | 19632282 | A1 | 2/1998 |
| GB | 953914 | A | 4/1964 |
| GB | 1349751 | A | 4/1974 |
| GB | 2194862 | A | 3/1988 |

OTHER PUBLICATIONS

"IR2159 Dimming Ballast Control IC", Oct. 8, 2001 International Rectifier, El Segundo, California, USA, XP002490255, pp. 1-26.
International Search Report of PCT/EP2007/061555 mailed on Aug. 11, 2008.

* cited by examiner

*Primary Examiner* — Thuy Vinh Tran

(57) ABSTRACT

An electronic ballast arrangement for a discharge lamp is provided. The electronic ballast arrangement includes an electronic ballast for a discharge lamp with a control application specific integrated circuit, the control application specific integrated circuit having a control input, which is characterized by the fact that the potential present across it sets the operating frequency of the control ASIC when driving the discharge lamp; and a switch; wherein the electronic ballast is connected to the switch, with different switching positions of the switch determining different potentials which are present at the control input, in order to thus set the operating frequency of the control application specific integrated circuit via the switch.

3 Claims, 1 Drawing Sheet

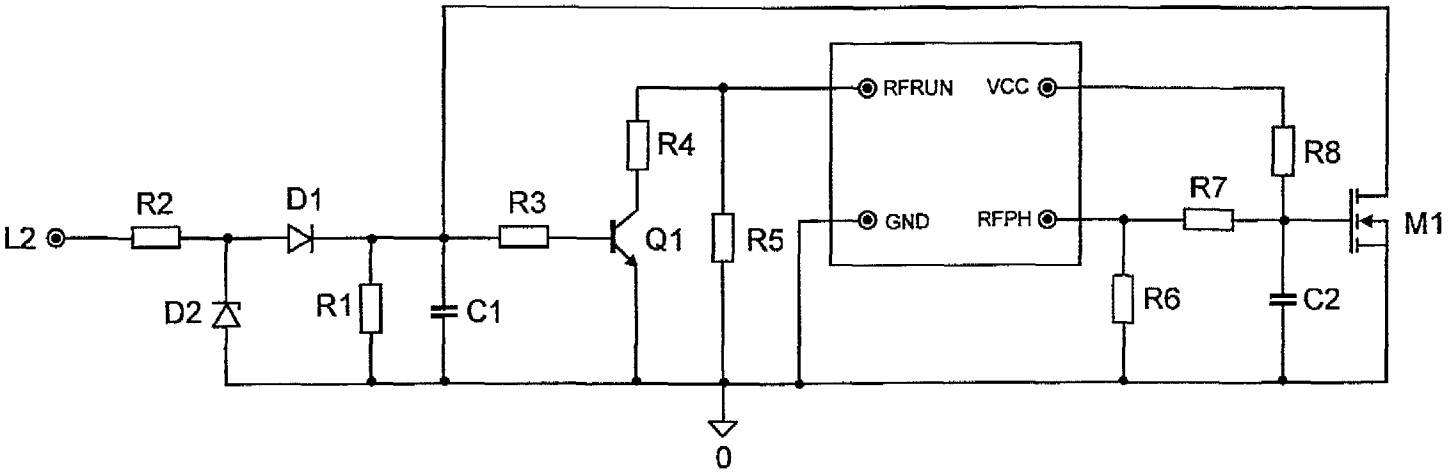
M1
R8
C2
R7
R6
VCC
RFPH
RFRUN
GND
R5
0
R4
Q1
R3
C1
R1
D1
D2
R2
L2

ELECTRONIC BALLAST FOR A DISCHARGE LAMP

RELATED APPLICATIONS

The present application is a national stage entry according to 35 U.S.C. §371 of PCT application No. PCT/EP2007/061555 filed on Oct. 26, 2007.

TECHNICAL FIELD

Various embodiments relate to an electronic ballast for a discharge lamp.

BACKGROUND

There are electronic ballasts with a large number of levels of complexity. Often, electronic ballasts have a microcontroller. In the case of such electronic ballasts, configurations are known which make it possible to dim the discharge lamp. The dimming function is controlled via a two-core control cable and a dimming potentiometer. Electronic ballasts can also include, instead of a microcontroller, a control ASIC (application specific integrated circuit). Such electronic ballasts are less complex. Until now, no electronic ballasts for discharge lamps with control ASIC have been known in which the dimming of the discharge lamp is controlled in another way than via a complex circuit with a dimming potentiometer.

SUMMARY

Various embodiments provide an electronic ballast for a discharge lamp which makes it possible to dim the discharge lamp with a compact and inexpensive design in order to be able to possibly thus save energy.

The electronic ballast is connected to a switch via a single-pole terminal, with different potentials being determined at different positions of said switch, which potentials are present at a specific control input of the control ASIC. This control input is characterized by the fact that the potential present across it sets the operating frequency of the control ASIC when driving the discharge lamp, i.e. the operating frequency above which the power is defined during operation (after the switch-on phase). The operating frequency of the control ASIC is therefore set via the switch. The operating frequency itself in turn determines the supply of energy to the discharge lamp. Different operating frequencies correspond to different emission powers of the discharge lamp. In other words, the discharge lamp is dimmed in one state in comparison with the other state.

In a preferred embodiment, the switch switches a mains connection (preferably a single-core cable) on or off, which mains cable is coupled to the control input of the control ASIC. The switch therefore functions in binary fashion. This embodiment can be provided in a particularly inexpensive and compact manner owing to its simplicity. This aspect of the invention is based on the knowledge that one advantage of dimming, namely that energy is saved, is also achieved when only a single dimming power stage is provided. For example, in the dimmed state 50% of the light energy can be emitted of the luminous efficiency in the undimmed state.

In a preferred embodiment, the electronic ballast includes a transistor, whose control input can be connected to the mains connection via the switch. The binary embodiment can therefore be implemented in a simple manner with a transistor, i.e. a component part which is particularly readily available and inexpensive. Then, a circuit can be influenced by the transistor, which circuit determines the potential at the control input of the control ASIC.

A configuration of the circuit which is particularly inexpensive to implement is one in which the transistor connects a resistor from the control input of the control ASIC to ground, in particular in parallel with another resistor. A current or potential in the circuit is altered by the resistor and is supplied precisely to the control input of the control ASIC.

Discharge lamps are generally preheated at a frequency of around 110 kHz, started at a frequency of around 75 kHz and then operated at a frequency of between 40 and 50 kHz if the intention is to emit full power. For dimming purposes, a frequency which is between the preheating frequency and the starting frequency, for example 85 kHz, is generally used. In the case of a control ASIC of the type used in the electronic ballast according to the invention, it may arise that, if the mains connection sets the operating frequency to 85 kHz, the starting frequency of 75 kHz is not reached after preheating, but the frequency remains at 85 kHz when it runs down from 110 kHz. In order to prevent this, a terminal of the control ASIC can be used, which terminal can be considered to be either the input or the output, and which terminal is at a different potential in the switch-on phase of the discharge lamp than after the switch-on phase. In particular, an output can be used which is used for driving a preheating transformer. This terminal of the control ASIC is coupled to the control input of a transistor, and the drain output thereof is then coupled to the control input of the first transistor. In the switch-on phase, therefore, the further transistor is switched, and the potential at the control input of the first transistor remains at zero, with the result that in the switch-on phase, the situation in which the mains connection is switched off is extended. Once the switch-on phase has ended, the switching of the further transistor is ended, the mains potential at the control input of the first transistor can be formed, and a corresponding potential is then present at the control input of the control ASIC via which the operating frequency of the control ASIC is set (after the switch-on phase). This ensures that the discharge lamp is switched on, i.e. preheated and started, in a reliable manner when it is intended to be dimmed immediately after being switched on.

BRIEF DESCRIPTION OF THE DRAWING(S)

The invention will be explained in more detail below with reference to an exemplary embodiment. The single FIGURE shows a circuit diagram of those of the components of the electronic ballast according to the invention which are essential to the explanation of the invention.

DETAIL DESCRIPTION

The following detailed description refers to the accompanying drawings that show, by way of illustration, specific details and embodiments in which the invention may be practiced.

In a preferred embodiment of an electronic ballast according to the invention, the control ASIC ICB1FL02G by Infineon is used for driving discharge lamps. The control ASIC has an input "RFRUN", which serves the purpose of setting the operating frequency of the control ASIC, i.e. the frequency which is applied to the discharge lamp, in particular once the discharge lamp has run through a switch-on phase with preheating and starting. The operating frequency is set via the potential which is present at "RFRUN" or the current which results through the connected resistor. This voltage drops across a resistor R5 at 11 kΩ. A resistor R4 with a resistance of 13 kΩ, in series with a transistor Q1, is connected in parallel with the resistor R5. The resistor R4 can be connected in parallel and switched off via the transistor Q1. The potential at the control input "RFRUN" can therefore be influenced via the transistor Q1. A single switch (for example a toggle switch), via which a control potential can be applied to the transistor Q1, is now connected to the electronic ballast. This switch is not shown in the FIGURE. It connects an input L2 of the circuit arrangement of the electronic ballast to a mains potential. The input L2 is connected to the control input of the transistor Q1 via a resistor R2 with a resistance of 1 MΩ and a diode D1 as well as resistor R3 with a resistance of 10 kΩ. A zener diode D2 can be connected to ground in the off direction between the resistor R2 and the diode D1 in order to divert interference pulses out of the power supply system. A resistor R1 with a resistance of 20 kΩ and a capacitance C1 of 1 nF are connected in parallel with one another and to ground between the diode D1 and the resistor R3.

If no mains potential is present at L2, the transistor Q1 is off, and the voltage present between RFRUN and GND is determined by R5 alone. When equipping the electronic ballast with components with the characteristics illustrated in the FIGURE, once the electronic ballast has been switched on, said electronic ballast first runs through a preheating phase, in which a frequency of 110 kHz is applied to the discharge lamp. With a target of a minimum of 3.3 J and a maximum of 5.7 J, a preheating energy at a preheating time of 1 s is actually achieved which is 3.8 J. After the preheating, the frequency is run down to 75 kHz, and starting is introduced. The starting time is 22 ms, and the starting voltage is 900 Vrms. Then, the actual operation is introduced, to be precise the control ASIC is operated at an operating frequency of 43 kHz in order to emit a maximum luminous efficiency. The mains power is in this case 60.7 W, the lamp voltage is 122 V, the lamp current is 457 mA and the lamp power is 55.6 W. At losses of 5.1 W, an efficiency of 92% is achieved.

If the switch (not shown in the FIGURE) is now switched on, with the result that the mains voltage is present at the input L2, the transistor Q1 switches on, and the voltage present between the input RFRUN and GND is determined by the parallel circuit including R5 and R4. In this case, the operating frequency again rises to 85 kHz in order to emit approximately half the maximum power. The mains power is 36.5 W, the lamp voltage is 167 V, the lamp current is 177 mA and the lamp power is 29.4 W. At losses of 7.1 W, an efficiency of 81% is achieved. An additional circuit is now also provided in the circuit arrangement of the electronic ballast, which additional circuit enables the switch-on operation when the mains voltage is present at the input L2 prior to switching on. As described above, the mains potential at the input L2 has the effect that the operating frequency is set to 85 kHz. After the preheating at 110 kHz, the frequency would therefore not be able to run down to the starting frequency of 75 kHz. A circuit is provided which delays the switching-on of the transistor Q1 until a point in time after the end of the switch-on phase, i.e. the preheating and the starting. For this purpose, a MOSFET M1 is provided, whose drain output is coupled to a point between the diode D1 and the resistor R3. The gate input of the MOSFET is connected to a voltage output VCC of the control ASIC via a resistor R8 with a resistance of 2.2 MΩ. The control input of the MOSFET M1 is connected to the connection GND via a capacitor C2 with a capacitance of 10 nF, and in addition the control input of the MOSFET is connected to a connection "RFPH" of the control ASIC via a resistor R7 with a resistance of 100 kΩ, said connection for its part being connected to the connection "GND" via a resistor R6 with a resistance of 11 kΩ. The connection GND is additionally coupled to the source connection of the MOSFET M1. The connection "RFPH" of the control ASIC is a connection at which a predetermined potential is present during the switch-on phase, i.e. the preheating and the starting, which potential changes after the switch-on phase. The circuit arrangement is configured such that the MOSFET M1 is switched on during the switch-on phase, with the result that the point between D1 and R3 is connected to ground. After the end of the switch-on phase, the MOSFET M1 is no longer turned on, and the potential determined by the input L2 can be set at the point between D1 and R3. If the mains potential is already present at the input L2 when the discharge lamp is switched on, if desired first the preheating at a frequency of 110 kHz takes place, then the starting at a frequency of 75 kHz, and subsequently the operating frequency rises again to 85 kHz in order to achieve dimming operation.

In the case of the electronic ballast according to the invention, a distinction is only drawn between two operating states, namely the emission of full power at an operating frequency of 43 kHz and emission of 50% power at an operating frequency of 85 kHz. Actuation of the switch makes it possible to alternate between these states, said switch effecting or ending the application of the mains potential at the input L2. The circuit arrangement has a particularly simple design and is particularly uncomplicated. In contrast to electronic ballasts with a more complex design, it is not possible to set any desired dimming power. However, by virtue of the fact that it is possible to alternate between emission with maximum energy and emission with 50% energy, an energy saving mode is provided, and this is sufficient for most energy saving purposes.

Likewise, installation in a luminaire is simplified. Conventional dimming ballasts are connected via a dedicated two-core control cable and a dimming potentiometer. In the electronic ballast according to the invention, only one additional core of the mains cable needs to be connected. Said core is connected to any desired phase of the mains system or to the neutral conductor via a mains switch (toggle switch). If the dimming input L2 has not been connected, a maximum power is always emitted.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is

1. An electronic ballast arrangement for a discharge lamp, the electronic ballast arrangement comprising:

an electronic ballast for a discharge lamp comprising a control application specific integrated circuit, the control application specific integrated circuit comprising a control input, which is characterized by the fact that the potential present across it sets the operating frequency of the control ASIC when driving the discharge lamp;

a switch input selectively coupled to a mains potential;

a first transistor having a first control input, the control input selectively coupled to said mains potential at said switch input via a resistor; and a second transistor having, a drain output connected to the control input of the first transistor, and a second control input connected to an input or output of the control application specific integrated circuit which is at a different potential in the switch-on phase of the discharge lamp than after the switch-on phase, wherein connecting said switch input to a mains potential provides a different potential at said control input than when said mains potential is disconnected from said switch input, in order to thus set the operating frequency of the control application specific integrated circuit.

2. The electronic ballast arrangement as claimed in claim 1, wherein the mains connection is provided by a single-core cable.

3. The electronic ballast arrangement as claimed in claim 1, wherein the first transistor is configured to connect a resistor from the control input of the control application specific integrated circuit to ground.

* * * * *